US006874297B2

(12) United States Patent
Solis et al.

(10) Patent No.: US 6,874,297 B2
(45) Date of Patent: Apr. 5, 2005

(54) STRETCH WRAP APPARATUS

(75) Inventors: Alfonso Solis, Franklin Park, IL (US); Jimmy Bennett, Franklin Park, IL (US)

(73) Assignee: Arpac, L.P., Schiller Park, IL (US)

( * ) Notice: Subject to any disclaimer, the term of this patent is extended or adjusted under 35 U.S.C. 154(b) by 0 days.

(21) Appl. No.: 10/658,160

(22) Filed: Sep. 9, 2003

(65) Prior Publication Data

US 2004/0045259 A1 Mar. 11, 2004

Related U.S. Application Data

(60) Provisional application No. 60/409,548, filed on Sep. 9, 2002.

(51) Int. Cl.[7] ..... B65B 11/04

(52) U.S. Cl. ..... 53/399; 53/414; 53/582; 53/589; 53/590; 53/587; 53/217

(58) Field of Search ..... 53/399, 414, 582, 53/589, 587, 217, 590, 211, 214, 218

(56) References Cited

U.S. PATENT DOCUMENTS

| | | | | |
|---|---|---|---|---|
| 3,986,611 A | | 10/1976 | Dreher | |
| 4,152,879 A | * | 5/1979 | Shulman | 53/399 |
| 4,271,657 A | | 6/1981 | Lancaster, III et al. | |
| 4,300,326 A | | 11/1981 | Stackhouse | |
| 4,409,776 A | * | 10/1983 | Usui | 53/399 |
| 4,418,510 A | | 12/1983 | Lancaster, III et al. | |
| 4,432,185 A | * | 2/1984 | Geisinger | 53/138.2 |
| 4,563,863 A | | 1/1986 | Humphrey | |
| 4,651,507 A | | 3/1987 | Koerschner et al. | |
| 4,807,427 A | | 2/1989 | Casteel et al. | |
| 5,088,270 A | | 2/1992 | Diehl | |
| 5,447,009 A | * | 9/1995 | Oleksy et al. | 53/399 |
| 5,463,843 A | * | 11/1995 | Sharp | 53/399 |
| 5,791,020 A | * | 8/1998 | Eichstadt | 24/16 R |
| 5,802,810 A | * | 9/1998 | Wojcik et al. | 53/399 |
| 6,195,968 B1 | | 3/2001 | Marois et al. | |

* cited by examiner

*Primary Examiner*—Scott A. Smith
*Assistant Examiner*—Brian D Nash
(74) *Attorney, Agent, or Firm*—Levenfeld Pearlstein LLC; Leon I. Edelson; William C. Clarke

(57) ABSTRACT

The instant invention comprises an apparatus and method for wrapping a load under tension with a web of stretch wrap flexible material and then binding the wrapping material to the load by compressing the end of the flexible material into a rope-like configuration. The rope formed is wound around the load at least one turn. A second turn of the rope around the load is then bound to the first rope with a mechanical twisting tie around the two ropes to prevent unwrapping of the load during transit and storage. A hot wire cutting mechanism cuts the rope and the bound two ropes snap back into position against the wrapped load from the force of the stretch wrap tension.

16 Claims, 2 Drawing Sheets

STRETCH WRAP APPARATUS

This application claims the benefits of Provisional Patent Application Ser. No. 60/409,548 filed Sep. 9, 2002.

FIELD OF THE INVENTION

The field of this invention relates to a mechanical stretch wrap apparatus that twists a mechanical fastening around stretch wrap material ends and secures the flexible material tail of a wrapping material around a container once the wrap of the container is complete. After wrapping a container or a pallet of packages with flexible material, there is a tail of wrapping film or netting once the material is cut which must be secured to the wrapped package or the wrap can become undone in shipment or storage. The stretch wrap apparatus suitably fastens stretch wrap material comprising stretchable film, stretchable and non-stretchable netting.

More specifically, the field of this invention relates to a stretch wrap apparatus and method for wrapping and tying a load with a flexible material which is supplied as a material web of a roll of material or as a rope. The apparatus operates by rotating a loaded pallet and applying under tension a flexible stretch material, a film or a netting, in a winding manner to the pallet load. The instant invention comprises a mechanical fastening and binding process that secures the flexible stretch material to the pallet load once the wrap of the pallet load is complete. The mechanical fastening process applies a mechanical twistable fastener as a tie to secure the flexible stretch material tail to the pallet load in the final winding wrap cycle of the wrapping process. The term "tail" refers to the material tail that results from a roll of material after wrapping a pallet load with flexible material and the material web is cut by a cutting mechanism. The material tail of the web needs to be secured to the pallet load or the wrap can come undone in shipment or storage.

The instant invention is a unique stretch wrap fastening and binding apparatus and method that forms a compressed rope from the material tail end of the material web wrap after the load is wrapped with the web of material. The material rope is tied using a mechanical fastener as a twistable tie mechanism applied to the material rope fashioned from the material web. The stretch wrap fastening apparatus and method is controlled by a programmable logic controller.

It is an object of this invention to provide a stretch wrap and fastening apparatus for wrapping a load under tension by means of a flexible material web which is formed into an elongated rope after the load has been wrapped either as a full web wrap or as a spiral web wrap. The apparatus is programmed to compress the flexible material web into a rope-like elongated configuration.

It is an object of this invention to provide an apparatus for fastening the final tail end of the flexible material web to the beginning tail end of the flexible material film web to prevent the flexible material web from unwrapping itself from the wrapped load.

It is an object of this invention to supply a stretch wrap fastening apparatus for wrapping a load under tension which apparatus comprises (a) a rotatable means for rotating a load to be wrapped controllable by a programmable logic controller to wrap the load with the wrap material under tension, (b) a supply means for stretch wrap flexible material which supply means is controllable by a programmable logic controller to wrap the load with the wrap material under tension, (c) a rope making means for compressing the web of the supply of stretch wrap flexible material into an elongated rope which rope making means is controlled by a programmable logic controller, (d) a first holder positioning means for holding and positioning at a predetermined space apart from said load being wrapped a first rope portion of said elongated rope from said rope making means which first holder positioning means is controlled by a programmable logic controller, (e) a second holder positioning means for holding and positioning at a predetermined space apart from said load being wrapped a second rope portion of said elongated rope from said rope making means which second holder positioning means is controlled by a programmable logic controller, (f) a cut-clamp hot wire mechanism means for clamping said second portion of said elongated rope from said rope making means, said clamping at a predetermined location from said second holder portion after said second holder positioning means positions second portion of said elongated rope at a predetermined space apart from said load which cut-clamp hot wire mechanism means is controlled by a programmable logic controller, (g) a twist tie mechanical means for fastening and binding together said first portion and said second portions of said elongated rope from said rope making means at a predetermined fastening and binding location which twist tie mechanism means is controlled by a programmable logic controller, said portions of said elongated rope designated as first and second ropes and first and second rope portions, (h) a cutting means of said cut-clamp hot wire mechanical means for cutting said second portion of said elongated rope from said rope making means at a predetermined location after said predetermined fastening and binding location of said first and second portions of said elongated rope which cutting means of said cut-clamp hot wire mechanical means is controlled by a programmable logic controller, (i) a controlling means for controlling a rotatable means for rotating said load to be wrapped, a supply means for stretch wrap flexible material, a rope making means for compressing the web of supply of stretch wrap flexible material into an elongated rope, a first holder positioning means, a second holder positioning means, a cut-clamp hot wire mechanical means for clamping a second rope portion of said elongated rope, a twist-tie mechanical means and a cutting means of said cut-clamp hot wire mechanical means which said controlling means is a programmable logic controller.

It is a further object of this invention to provide a method for operating a wrapping apparatus to bind a wrap of stretch wrap material to itself once the wrap of the load is complete, the wrapping apparatus having a fastening and binding mechanism and a source of stretch wrap flexible material, said method of operation for fastening and binding the stretch material to itself to secure the stretch material wrap around a load utilizing a mechanical twist tie mechanism to fasten and bind the stretch material to itself with the next to last wrap and final wrap around the wrapped load which method comprises a) placing a load to be wrapped upon a stretch wrapping apparatus comprising a turn-table for rotating a load with rotational tension, b) supplying a stretch wrap flexible material from a supplying means under tension as a material web to wrap the load, c) positioning the stretch wrap flexible material onto the load to affix the web of flexible material to the load, d) rotating the load on said turn table to wrap the load under tension as a full web wrap and as a spiral web wrap to provide a full wrap of the load wherein said flexible material is grabbed by a roping device at the end of the first full wrap revolution of the load, e) compressing of said flexible material by said roping device to compress web of said material into a rope-like configuration as a first rope portion wrapped around the load for holding by a first holder positioner as said turn-table continues to rotate the load for a second full revolution of the load to provide a second rope portion of said rope-like configuration wrapped around the load for holding by second holder positioner, f) activating two rope holder positioners to move from home positions to catch the rope-like configuration as said first rope portion and said second rope portion at predetermined locations designated as first and second ropes, g) activating a cut-clamp hot wire mechanism to move from home position to clamp onto second rope of said rope-like configuration at a predetermined location after the second rope holder positioner, h) activating a twist-tie mechanism to move from home position to fasten and bind together first rope and second rope of said elongated rope-like configuration as a tied unit at a predetermined location between said two rope holder positioners, i) activating said cut-clamp mechanism to cut the second rope of said elongated rope-like configuration at said predetermined location by a hot wire mechanism, j) releasing said tied unit of said first rope and second ropes from said rope holder positioners wherein said tied unit snaps back into position against the wrapped load from force of the stretch wrap tension, k) activating said supplying means of said stretch wrap flexible material to return to home position, activating said roping device, said rope holder positioners, said cut-clamp hot wire mechanism, and twist-tie mechanism to return to home positions.

DESCRIPTION OF THE PRIOR ART

Pallet wrapping machines are well-known in the art and provide an apparatus for making a unitized package of multiple containers of multiple products stacked upon a pallet for ease of transport and handling. The wrapping material can be paper or plastic film or netting of stretch and of heat shrinkable characteristics. The ends of the wrapping material are secured to the unitized package to maintain the security of the package by preventing the undoing of the wrap in shipment or storage. Paper wraps can be glued or taped. Plastic films and netting of stretch and heat shrinkable characteristics offer aesthetic and visual advantages in that the interior contents of the wrapped package can be viewed through suitable plastic film and netting for visual inspection.

Many methods and devices have been taught in the prior art for securing stretch wrap material around a palletized load. The use of a heat sealing method can pose problems in controlling the application of heat. Clamping of a stretch wrapping material by gripping a single film or netting thickness can cause tearing or severance of the film or netting when high wrapping tension is used. Brush wipe downs of "cling" stretch film in the short term are effective but can come apart in the long term.

U.S. Pat. No. 3,986,611 to Dreher discloses a cling film overwrap and a method of tension enveloping articles supported on a pallet. A flexible cling film leading edge is twisted or crushed to form a rod-like segment placed between layers of boxes of the pallet load. Layers of film web are tension wrapped around the pallet load. The trailing edge of the film web is secured to the underlying film wraps by a brush positioned to impart a planishing pressure wipe to the cling film as the film contacts and adheres to the surface of the underlying layers of cling film tension wrapped around the load. Tension wrapping of the cling film is preferably under a force of about 1 lb. per inch as the force necessary to slightly stretch the film so the film will not sag or otherwise lose its tautness.

U.S. Pat. No. 5,088,270 to Diehl discloses a film-tail heat sealing system and heat seal assembly for securing stretch film wrapped around a package. The assembly grasps, aligns two strips of roped film wraps and heats adjacent faces of the roped film sections. The heated faces are compressed to weld them together and secure the film wrap around the package. The weldment is provided between overlapped and roped film wraps to be joined by heating the relatively low-temperature melting material to a surface temperature of a molten or gelatinous state. A pressure bar presses the film rope wrap against a heater element. Temperature control is accomplished by maintaining the film rope in contact with the heater element for a predetermined time, the heater element being maintained at a fixed temperature. The sequence of operations is controlled by a control system which may incorporate a central processing unit (CPU) operable to receive signals from a remote sensing apparatus and provides output signals to solenoid operators.

U.S. Pat. No. 4,807,427 to Casteel, et al., discloses a film rope forming apparatus for compressing the web of stretch film into a film rope configuration which engages preformed and located notches within the top and bottom caps of the package. The stretch film rope provides a continuous compression band at the top and bottom caps of the package within the said notches. The amount of film web stretch is determined by the type of stretch film used and speed differential between rubber rollers of the supply film roll dispenser and the packaging requirements. The compression band within the notches of the package serves to retain the web rope ends of the stretched film wrap. After the package is wrapped, the film web is cut and the package is released from the apparatus. The film web is ready for the next package.

U.S. Pat. No. 4,418,510 to Lancaster, et al., teaches a process and apparatus for applying stretchable plastic film to loads wherein the plastic film is elongated beyond its yield point to cause the film to gain in modulus and ultimate strength. Closure of the film ends can be obtained by a mechanical closure mechanism or the final film end can be brushed onto the underlying film layers on the load or tucked heat sealed to the load. The preferred closure embodiment is a tying mechanism such as a hog ringer device which feeds staples or hog rings to engage the materials to be tied together. In operation, the shaped nose of the hog ringer is around the materials to be held together and the ring or a staple is driven around the material held in the nose by bending the ring or staple around the items to be tied. Thus the two roped web layers which have been placed side by side are fastened together through the action of the hog ring passing a staple around both of the ropes and fastening or tying them together through the contraction of the staple or bending of the staple or ring around the materials.

U.S. Pat. No. 4,300,326 to Stackhouse and U.S. Pat. No. 4,271,657 to Lancaster, Ill, et al., teach apparatus for closure of the ends of stretch material for wrapping packages wherein the leading edge of the material from the dispenser is held by a clamp mechanism of the turn table and the turn table is rotated to wrap the load with the material being stretched as it is wrapped around the load. The material is spirally wrapped around the load and is formed into a rope-like configuration which is carried adjacent the clamped leading edge where it is tied to the clamped leading edge. The tying mechanism is a mechanical closure device, a standard hog ringer device such that a magazine feeds staples or hog rings. The hog ring engages the materials to be tied together and a ring or staple is fastened around the materials to be tied. After the leading and trailing ends are tied together, the clamped leading edge of the material is released, the roped trailing edge is severed, and the rope sections move to the original memory positions of the material. A new unwrapped load is positioned on the turn table to start a new wrapping operation.

U.S. Pat. No. 4,563,863 to Humphrey, discloses an automatic stretch wrapping machine which uses stretchable wrapping material for securing a load without complicated wrapping, clamping and shearing structures. The invention minimizes loose "tails" by the location of the clamping and cutting mechanisms at one end of the turn table and permits application of full wrapping tension from the beginning of wrapping to minimize the amount of stretch wrapping material and eliminates tearing of the wrapping material which can be a problem with clamps. The attachment of the trailing edge of the wrapping material by brushing it against the underlying layer eliminates complicated tying structures of some machines. The brush against the load and the reliance on the inherent cling of the plastic material secures the trailing end of the stretch wrapping material without requiring complicated mechanical tying structures.

U.S. Pat. No. 4,651,507 to Koerschner discloses a tie-off closure method for wrapping plastic netting around a load on a pallet. The method utilizes a hand-held device comprising a plastic clip having a slot which extends into a mid-portion of the body of the clip and has a plurality of slits or notches which extend into the body of the clip. The problem with working with netting as a means for palletizing and securing packaged loads has been how to secure the pallet net wrap after cutoff to maintain the tension of the net wrap. The tie-off closure method utilizes a plastic clip wherein the net strands are channeled into the openings of the slots to engage the net strands. After the engaged strands in the slots of the clip are cut between the netting supply and the netted load, the clip holding the net strands will snap back to the load and hold securely against the load, thus tying off the netted load.

U.S. Pat. No. 6,195,968 B1 to Marois discloses an apparatus and method for wrapping a load by means of a flexible material wherein the apparatus treats two tails, or ropes, of a flexible wrapping material in a pallet wrapping machine. The fastening means for tying the two ropes together is a staple. The apparatus is operated to supply a flexible wrapping material as a first rope which is then supplied as a full web. The first rope is tied around the load by rotating the first rope around the load by a rotatable arm mounted on a boom before the load is wrapped with the full web. Once the load is wrapped with the full web, the flexible material is supplied as a second rope. The end of the first rope, which is now wrapped around the load and the second rope are aligned together as suplied by the rotatable arm moving around the load. A clipper mechanism clips the two ropes together by a staple. The second rope is then cut by a heat wire. The device accordingly comprises a supplying means, a first positioning means for a first rope, a means for moving an arm in a circular motion to wrap the first rope and flexible material around the load, a second positioning means for a second rope, a fastening means for fastening the two ropes together, a cutting means for cutting the second rope and a controlling means for controlling the operation.

However, the stretch wrap apparatus and methods taught in the prior art for wrapping a load by means of a flexible material relate to methods which utilize the material characteristics of the flexible material as salient aspects of the method used. The heat sealing method uses the melt temperature of the material. The mechanical closure, i.e., the hog ringer device, relies on the tensile strength of the material to avoid being torn apart after being punctured by insertion of the hog ring or staple. The tie-off method of Koerscher is suitable for plastic netting wherein the strands of the netting are gathered by means of a slotted plastic clip to tie off the netted load. The instant invented method however provides an apparatus and method for tying off a load with use of different materials such as flexible film and netting by not relying upon the material characteristics of the flexible material used. The instant invented apparatus and method does not rely on the tensile strength of the wrapping material to withstand longitudinal stress occasioned by puncturing of the material or upon the melt temperature of the material. Netting material can be gathered and utilized in the same procedure as other flexible material.

Other mechanisms in the prior art include roller or brush wipe downs, as well as heat seals. The wipe down method relies on the "cling" tendency of the film. This method can be effective over the short term but in the long term it can come apart especially during shipment. Temperature exposure can reduce the "cling" factor of stretch film. Heat sealing can be a proven method but sometimes the heat sealing burns through the film and damages product.

SUMMARY OF THE INVENTION

The present invention comprises an apparatus and system for securely wrapping under tension a pallet load with a stretch wrap flexible material to prevent the unwrapping of the stretch wrap material from the load during transit and storage. The apparatus and system are controlled by a programmable logic controller which activates and monitors the operations of the apparatus components. The apparatus and system comprise a turn table for rotating the pallet load, a controlled supply of stretch wrap flexible material on a film carriage to wrap the load under tension, a manual or mechanical means for attaching the stretch wrap flexible material to the load at the beginning of the wrap cycle, a controlled rate of rotation of the turntable to generate wrap material tension, a roping device to grab the flexible material and compress the material into a formed rope at the end of the first load wrap cycle, a series of rope holder positioners to catch the formed rope as the wrapped load continues to revolve after the end of the load material wrap cycle, the rope holder positioners catching the formed rope at a fixed predetermined height from the wrapped load as the load rotates through a first full rotation after completion of the first load wrap cycle to a second full revolution to provide a second section of the formed rope held by said rope holder positioners. A cut-clamp hot wire mechanism device is activated to catch the second section of the formed rope in its jaws. The said rope holder positioners hold the two sections of the formed rope with the second rope section held by the cut-clamp hot wire mechanism device. A tie-wrap device is activated to engage the two formed rope sections to fasten and bind the two rope sections together as a tied unit by placing a mechanical twisting tie around the two rope sections as held by the rope holder positioners with the second formed rope section held by the cut-clamp hot wire mechanism device. The cut-clamp hot wire mechanism device is activated to catch the second formed rope section in its jaws, the said rope holder positioners holding the two formed rope sections with the second rope section held by the cut-clamp hot wire mechanism device. The tie-wrap device is activated to fasten the two rope sections together by placing a mechanical twisting tie around the two rope sections as held by the rope holder positioners with the second formed rope section held by the cut-clamp hot wire mechanism device then disengaging from the two rope sections bound together as a tied unit. The said cut-clamp hot wire mechanism device is then activated to sever the second formed rope section from the supply of stretch wrap flexible material. The rope holder positioners are activated to release the formed rope sections to secure the wrapped load by the released ropes as a tied unit retracting against the wrapped load from the force of the stretch wrap tension.

DETAILED DESCRIPTION OF THE EMBODIMENT

The present invention is designed to use any type of stretchable material. The present invention can function with stretchable film webs such as nylon, polypropylene, polyvinylchloride, polybutylene, polyethylene or any copolymer or blends of the aforementioned stretchable films. The present invention can function with stretchable polyethylene netting and also with polypropylene netting.

Figure 1:
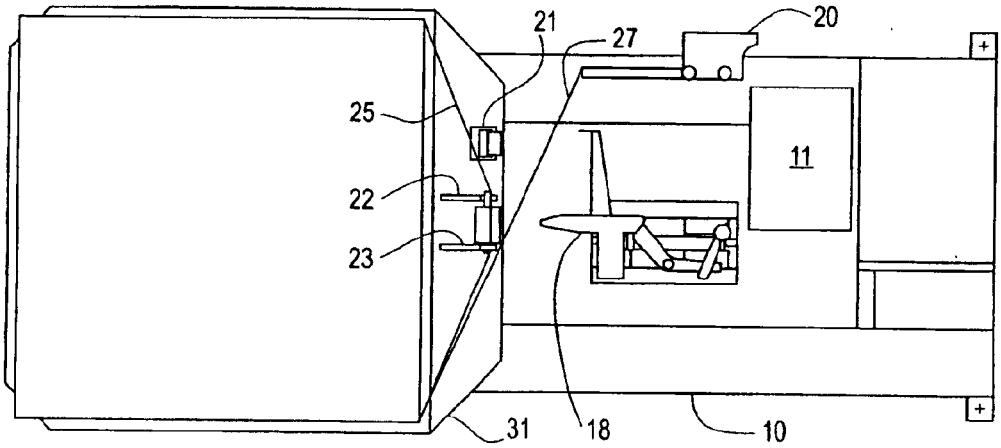
FIG. 1 is a top view of an apparatus of a preferred embodiment of the invention.
Figure 2:
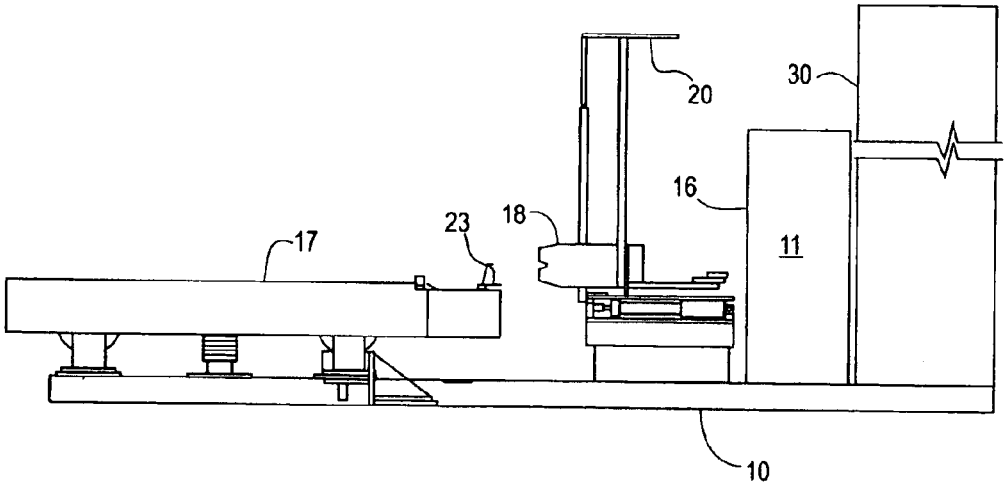
FIG. 2 is a side view of the apparatus of FIG. 1.
Figure 3A:
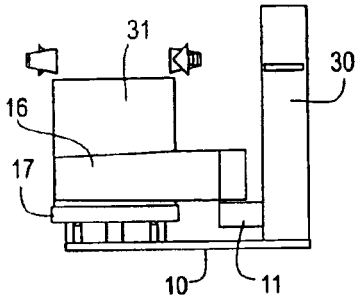
FIG. 3 (*a–g*) is a plain view of a spiral wrap of a package of a full wrap.
Figure 3B:
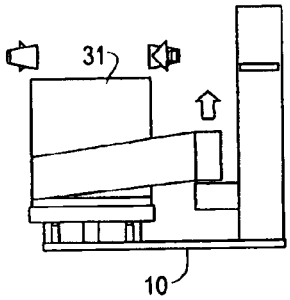
Figure 3C:
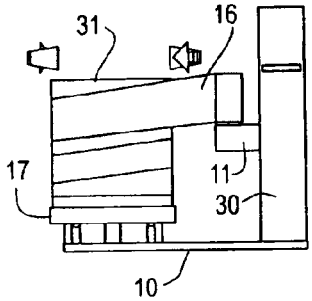
Figure 3D:
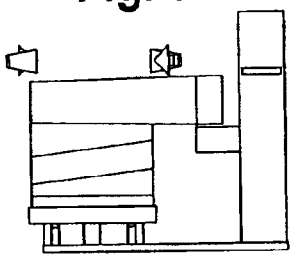
Figure 3E:
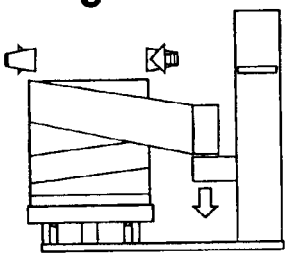
Figure 3F:
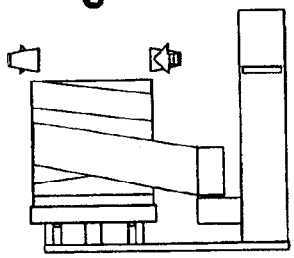
Figure 3G:
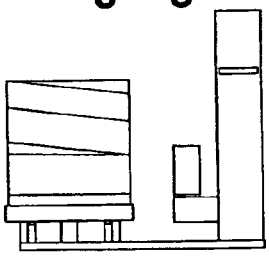
Figure 4:
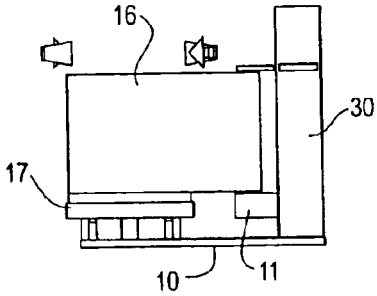
FIG. 4 is a plain view of a full web wrap cycle.

FIGS. 1–2 illustrate the components of the instant invention, the components comprising a turn-table 17, a supply of stretch wrap flexible material 16 from a supply source within the flexible material carriage 11, a roping device 20, a clamp cut hot wire mechanism device 21, rope holder positioners 22 and 23, a tie-wrap device 18, first formed rope 25 and second formed rope 27. The programmable logic controller 32, not shown, is located in tower 30. The wrapped pallet load 31 is pictorially represented in the top view of FIG. 1.

FIG. 2 is a side view of the components of FIG. 1 of the instant invention and the components thereof, the turn table 17, the twist tie mechanism 18, the material carriage 11 for stretch wrap flexible material 16 held within material carriage 11, the roping device 20, a first rope holder positioner 23, and the machine tower 30 with the programmable logic controller 32 ("PLC") located within, not shown.

Referring now to FIGS. 1–4, the apparatus of the present invention includes a frame 10 upon which is mounted the turn table 17. On frame 10 is mounted a flexible material carriage 11 containing a supply of stretch wrap flexible material 16, not shown, rotatably mounted on the flexible material carriage 11. Material carriage 11 comprises the supply means for the stretch wrap flexible material. Material carriage 11 has controllable up and down vertical motion.

A load 31 to be wrapped is placed on the stretch wrap machine by manual means, by a forklift truck or by a conveyor system, such means not being elements of the invention. The load comprises a single unit package of a single package or multiple units of packages upon a pallet to be unitized into a single wrapped package with an overwrap material which is sealed with a mechanical tie against unraveling and becoming unsealed.

As in the prior art, the apparatus includes means for effecting relative movement by a turn table rotating the load 31 and the supply means for the stretch wrap material 16 in order to wrap the load under rotational tension. The stretch wrap material 16 is positioned onto the load 31, either manually by the attending operator or mechanically by a separate mechanism not an element of the invention. Upon rotation of the turn table 17, as initiated by the operator by operation of PLC 32, the stretch wrap material 16 begins to wrap the load 31 under tension as the turn table 17 rotates faster than the film supply is supplied to provide rotational tension to the material. The material carriage 11 accordingly applies tension to the film material to stretch wrap the load.

Initiation of rotation of the turn table 17 by the operator by operation of PLC 32 initiates control of the wrapping cycle by PLC controller 32. PLC controller 32 counts the revolutions of the turn table 17. PLC controller 32 is programmed, as set by the operator, for either a spiral web wrap as in FIG. 3*a–g* or a full web wrap as in FIG. 4. At the end of the first wrap cycle, either a spiral web wrap or a full web wrap, PLC controller 32 activates rope making means device 20 by which the stretch wrap flexible material 16 is engaged prior to contact with load 31. Rope making means device 20 is attached to film carriage 11. Activation of rope making means device 20 by PLC controller 32 causes rope making means device 20 to form a rope-like configuration of the engaged stretch wrap flexible material by compressing the material web into a narrow band-like strip of material. Turn table 17 continues to rotate as the first formed rope 25 is formed by rope making means device 20 and formed rope 25 is wrapped around load 31. At the end of the first full web wrap cycle, PLC controller 32 activates rope holder positioners means 22 and 23 to active positions to engage the first formed rope 25 as first formed rope 25 is wrapped around load 31. Rope holder positioners means 22 and 23 position first formed rope 25 at a predetermined space apart from load 31. As first formed rope 25 wraps around load 31 as caused by revolution of turn table 17, rope making means device 20 continues to form a rope-like configuration of the stretch wrap flexible material into what is designated as second formed rope 27, which is a continuation of first formed rope 25. As the turn table 17 completes its first full revolution after the first full web wrap cycle, the second formed rope 27 and first formed rope 25 are engaged and held by rope means holder positioners means 22 and 23, both first formed rope 25 and second formed rope 27 held at a predetermined space apart from load 31. At the end of the first full revolution of the turn table after the first wrap cycle to complete the second wrap cycle, the second stretch wrap flexible material rope 27 is engaged by the cut-clamp hot wire mechanism means module 21. Concurrently, as the turn table 17, as controlled by PLC controller 32, stops in its home position, the tie wrap mechanical means device 18 is activated to move forward into position to push onto first formed rope 25 and second formed rope 27 held by rope holder positioners means 22 and 23. Tie wrap device mechanical means 18 mechanically ties first formed rope 25 and second formed rope 27 together between the two rope holder positioners means 22 and 23 by the twistable tie mechanism of tie wrap mechanical means device. The twistable tie is a twist tie metal wire mechanical tie or a twist tie plastic wirelike mechanical tie of the two ropes 25 and 27. After the wire or wirelike tie is in place, the tie wrap mechanical means device 18 is activated to move backward into its home position by the PLC controller. The cut-clamp hot wire mechanism means is activated to sever the second formed rope 27 held by the cut-clamp hot wire mechanism means 21 by a hot wire of the cut-clamp hot wire mechanism 21 to form a tied unit of the first rope 25 and the severed tail end of the second rope 27. The tied unit then snaps back into position against the wrapped load from the force of the stretch wrap tension. The PLC controller activates the rope holder positioner means 22 and 23 to release ropes 25 and 27 and to retract into home position. The PLC controller activates the supply means of the stretch wrap flexible material, the two rope holder positioners, the cut-clamp hot wire cutting mechanism, the twist tie mechanical tie device to move into activated positions from home positions and to return to home positions. Activation of pneumatic cylinders can be a suitable means. The wrapped load with the secured tail of the stretch wrap material is removed from the stretch wrap tying apparatus.

While the preferred form of controller is a programmed microprocessor, it should be understood that the invention is not limited thereto. Alternatively, the controller may be based upon relay logic, fluidics or discrete digital logic programmed specifically for operating the present invention.

The controlling of the full sequence of operations of the stretch wrapping machine by a controlling means comprising a programmable logic controller is part of the present invention, including the controlling of a stretch wrapping machine to wrap a spiral web or a wide web or full web around a load.

A preferred form of a PLC controller which can be programmed to control the revolutions of the turn table, to activate and control the operations of the roping device, the rope holder positioners, the cut/clamp mechanism, the tie wrap device is a micro programmable logic controller (PLC) system (such as one made by Rockwell Automation of Milwaukee, Wis.).

A standard tie wrap device 18 (such as made by Plas-Ties, Tie-Matic model, of Santa Ana, Calif.) is preferable as providing the twistable tie mechanism that mechanically ties the tail ropes of the stretch material together to secure the tail end of the stretch material to the wrapped container. The twistable tie mechanism can comprise a twist tie metal wire mechanical tie or any suitable twist tie plastic wirelike mechanical tie provided by any available tie wrap device.

The stretch wrap flexible material can be any flexible film or netting, both of which are included in the description of "stretch wrap flexible material."

It should be noted that although a specific embodiment of the instant invention has been described, the present invention consists in the combination of a typical load wrapping device for wrapping a load with a stretch wrap material with a rotatable support means for wrapping a load under tension, a supply means for supplying the flexible stretch wrapping material under tension, a rope making means for supplying the flexible stretch wrapping material as a material web or as a rope as required by the wrap cycle, a first and a second rope holder positioner means for holding and positioning at a predetermined space apart from said load being wrapped a portion of a first rope supplied by said supply means and a portion of a second rope supplied by said supply means and held by said second positioner means for positioning at a predetermined space apart from said load being wrapped, a twist tie mechanical means for fastening and binding together portions of said first and second ropes to form a tied unit from said supply means and said rope making means, a cut-clamp hot wire mechanism means for clamping a portion of said second rope after first and second portions of said first and second ropes are twist tie bound together, hot wire cutting means of said cut-clamp hot wire mechanism means, and control means for the functions described. Although rope making devices, cut-clamp hot wire mechanism devices, rope holding devices, and programmable controllers have been specifically described and illustrated, the objects of the present invention could be met with other mechanical devices fulfilling the same functions.

What is claimed is:

1. An apparatus for wrapping and binding and fastening a load with a flexible wrapping material, said apparatus comprising:

(a) supply means for supplying the flexible stretch wrapping material as a full web wrap and as a spiral web wrap under tension, (b) a rotatable support means for rotating a load and wrapping a load with a material web wrap as a full web wrap and as a spiral web wrap of material under tension, (c) rope making means for supplying a rope-like configuration from the flexible stretch wrapping material as a material web by compressing the material web into a rope-like configuration under tension as required by a control means after said material web wrap, (d) first holder positioner means for positioning at a predetermined space apart from said load being wrapped a portion of said rope provided by said rope making means as a first rope section, (e) second holder positioner means for positioning at a predetermined space apart from said load being wrapped as a portion of said rope provided by said rope making means as a second rope section, as a continuation of said first rope section, (f) a twist tie mechanical tie means for binding together first and second ropes supplied by said supply means and provided by said rope making means, wherein said twist tie mechanical tie means fastens and binds together said first and second ropes as a tied unit between said first and said second holder positioner means (g) cut-clamp hot wire mechanical means for clamping portion of said second rope held in first and second holder positioners of first and second ropes fastened and bound together between said first and second holder positioner means, said clamping of second rope portion at a location apart from said first and second holder positioner means, and cutting said second rope portion at said location apart from said first and second holder positioner means (h) control means connected to said supply means, said rotatable support means, said rope making means, said first holder positioner means, said second holder positioner means, said twist tie mechanical tie means, and said cut-clamp hot wire mechanism means for controlling operations thereof.

2. The apparatus of claim 1 wherein said supply means is mounted in a carriage which can be controlled to move vertically.

3. The apparatus of claim 1 wherein said rotatable support means comprises a turn table activated and rotatably controlled by said control means.

4. The apparatus of claim 1 wherein said rope making means is activated to provide said flexible stretch wrapping material as a material web and as a rope-like configuration by said control means.

5. The apparatus of claim 1 wherein said first and second rope holder positioner means engage the first and second portions of said rope-like configuration designated as first and second ropes supplied by said supply means and said rope making means as activated by said control means, said second rope as a continuation of said first rope.

6. The apparatus of claim 1 wherein said cut-clamp hot wire mechanism means is activated to provide clamping of said second rope of said first and second ropes bound together between first and second holder positioner means at a location apart from said first and second holder positioner means and provide cutting of said second rope at said apart location and said cut-clamp hot wire mechanism means is controlled by said control means to clamp and cut said two ropes.

7. The cut-clamp hot wire mechanism means of claim 6 wherein said cut means of said cut-clamp hot wire mechanism means comprises a hot wire cutting mechanism.

8. The apparatus of claim 1 wherein said cut-clamp hot wire mechanism means comprises a hot wire cutting mechanism, said first and second holder positioner means comprise rope holder positioners, twist tie mechanical tie means comprises a mechanical twist tie device and said control means comprises a programmable logic controller.

9. The apparatus of claim 1 wherein said cut-clamp hot wire cutting mechanism, said rope holder positioners, said mechanical twist tie device are moved into activated positions by activation of pneumatic cylinders controlled by said control means which comprises a programmable logic controller.

10. The apparatus of claim 1 wherein said twist tie mechanical tie device binds together first and second ropes provided by said rope making means as a tied unit by placing a twist tie metal wire tie mechanism around said two ropes as held by said two rope holder positioners.

11. The apparatus of claim 1 wherein said twist tie mechanical tie binds together first and second ropes provided by said rope making means as a tied unit by placing a twist tie plastic wirelike tie mechanism around said two ropes as held by said two rope holder positioners.

12. The apparatus of claim 1 wherein release of first and second ropes fastened and bound together as a tied unit from holder positioners secures the wrapped load by the released ropes as a tied unit retracting against the wrapped load from the force of the stretch wrap tension.

13. In a wrapping apparatus having a fastening and binding mechanism and a source of stretch wrap flexible material, a method of fastening and binding the stretch material to itself to secure a stretch material wrap around a load utilizing a mechanical twist tie mechanism to fasten and bind the stretch material to itself with the next to last wrap and final wrap around the load which method comprises (a) placing a load to be wrapped upon a stretch wrapping apparatus comprising a turn-table for rotating a load with rotational tension, (b) supplying under tension a stretch wrap flexible material from a supplying means as a full material web to wrap the load, (c) positioning the stretch wrap flexible material web onto the load to affix under tension the flexible material web to the load, (d) rotating the load on said turn table to wrap the load under material web tension as a full material web wrap and as a spiral web wrap to provide a material web wrap of the load under tension wherein said flexible material web is grabbed by a roping device at the end of the first full wrap revolution of the load, (e) compressing of said flexible material web by said roping device to compress said material web for holding by a first holder positioner of a rope-like configuration wrapped around the load as said turn-table continues to rotate the load for a second full revolution of the load to provide a second portion of a rope-like configuration wrapped around the load for holding by second holder positioner, (f) activating two rope holder positioners to move from home positions to catch the rope-like configurations at predetermined locations, (g) activating a cut-clamp hot wire mechanism to move from home position to clamp onto second portion of said rope-like configuration at a predetermined location after the second rope holder positioner, (h) activating a twist-tie mechanism to move from home position to fasten and bind together as a tied unit of first portion and second portion of said elongated rope-like configuration as first and second ropes at a predetermined location between said two rope holder positioners, (i) activating said cut-clamp mechanism to cut the second portion of said elongated rope-like configuration at said predetermined location by a hot wire mechanism, (j) releasing said tied unit of said first and second ropes from said rope holder positioners wherein said tied unit snaps back into position against the wrapped load from force of the stretch wrap tension, (k) activating said supplying means of said stretch wrap flexible material to return to home position, activating said roping device, said rope holder positioners, said cut-clamp hot wire mechanism, and twist-tie mechanism to return to home positions.

14. The method of claim 13 for fastening and binding said stretch material to secure a stretch material web wrap around a load to fasten and bind the stretch material web to itself with the next to last wrap and the final wrap around the load utilizing a mechanical twist tie mechanism wherein the mechanical twist tie mechanism comprises a twist-tie metal wire tie mechanism.

15. The method of claim 13 for fastening and binding said stretch material web wrap around a load to fasten and bind the stretch material web to itself with the next to last wrap and the final wrap around the load utilizing a mechanical twist tie mechanism wherein the mechanical twist tie mechanism comprises a twist tie plastic wirelike tie mechanism.

16. The method of claim 13 for fastening and binding said stretch material web to secure a stretch material web wrap around a load to fasten and bind the stretch material tail end to itself as a tied unit utilizing a mechanical twist tie mechanism wherein said stretch material on release of said fastening and binding snaps back into position against the wrapped load from the force of the stretch wrap tension.

* * * * *